US012509982B2

(12) United States Patent
Jordan et al.

(10) Patent No.: US 12,509,982 B2
(45) Date of Patent: Dec. 30, 2025

(54) DETECTION OF TOP OF CEMENT WITHIN AN ANNULAR ENVIRONMENT

(71) Applicant: Expro Americas, LLC, Houston, TX (US)

(72) Inventors: John Christopher Jordan, Houston, TX (US); Maxim Tseplic, Houston, TX (US); Steve Russell, Houston, TX (US)

(73) Assignee: Expro Americas, LLC, Houston, TX (US)

( * ) Notice: Subject to any disclaimer, the term of this patent is extended or adjusted under 35 U.S.C. 154(b) by 0 days.

(21) Appl. No.: 18/617,906

(22) Filed: Mar. 27, 2024

(65) Prior Publication Data

US 2025/0305407 A1 Oct. 2, 2025

(51) Int. Cl.
*E21B 47/005* (2012.01)
*E21B 33/16* (2006.01)
*E21B 47/11* (2012.01)

(52) U.S. Cl.
CPC ..... *E21B 47/005* (2020.05); *E21B 33/16* (2013.01); *E21B 47/11* (2020.05)

(58) Field of Classification Search
CPC ..... E21B 47/005; E21B 33/16; E21B 47/11
See application file for complete search history.

(56) References Cited

U.S. PATENT DOCUMENTS

| | | | | |
|---|---|---|---|---|
| 9,133,698 | B2 * | 9/2015 | Myers | E21B 33/134 |
| 9,879,519 | B2 | 1/2018 | Roberson | |
| 10,053,979 | B2 | 8/2018 | Rasmus | |
| 10,539,003 | B2 | 1/2020 | Gao | |
| 10,738,590 | B2 | 8/2020 | Ravi | |
| 2011/0192593 | A1 * | 8/2011 | Roddy | E21B 47/138 166/250.01 |
| 2020/0173252 | A1 * | 6/2020 | Lende | E21B 33/16 |
| 2020/0232315 | A1 * | 7/2020 | Gomes | E21B 47/047 |
| 2021/0238980 | A1 * | 8/2021 | Vargo, Jr. | E21B 47/138 |

* cited by examiner

*Primary Examiner* — Robert E Fuller
(74) *Attorney, Agent, or Firm* — Getz Balich LLC

(57) ABSTRACT

A method for detecting a top of cement (TOC) within an annulus of a subterranean wellbore includes providing a frangible compartment in a wiper plug, frangible compartment containing a detectable material, launching the wiper plug into the wellbore ahead of a cement slurry, causing the wiper plug to strike or land on a casing shoe withing a casing thereby creating an impact that causes the frangible compartment within the wiper plug to be ruptured to release the detectable material into the casing, pumping the cement slurry to pass through the wiper plug such that the released detectable material forms a leading portion of the cement slurry and rises up in an annulus of the wellbore, and detecting the detectable material at a top of cement (TOC) when the detectable material in the annulus passes by a plurality of sensors.

20 Claims, 4 Drawing Sheets

DETECTION OF TOP OF CEMENT WITHIN AN ANNULAR ENVIRONMENT

BACKGROUND OF THE DISCLOSURE

1. Technical Field

The present disclosure relates generally to a cementing operation in the subterranean wellbore, and in particular to a system, method and apparatus for identification of a level of cement in the annular region after a well cementing operation.

2. Background Information

Oil wells are drilled for recovering hydrocarbons from the subterranean region. As the drilling is complete, a casing is introduced into the wellbore and cemented into place. Cementing operation involves pumping a cement slurry down through the casing, out of the bottom of the casing, and upwards into the annulus formed between the casing and the formation so as to fix the position of the casing in the wellbore. Additionally, the cementing achieves zonal isolation which prevents other fluids such as water or gas, from the wellbore, from entering the casing.

The leading edge of the cement in an annulus also called as top of cement (TOC) may be an efficient factor during cementing operations, wherein the TOC may be detected to help measure the amount of cement required to fill the annular space, so as to avoid having less than the adequate amount of cement within the annulus, which would result in a weak structure between the formation and the casing. However, it is observed that in the present-day-technologies, detection of the TOC requires the installation of a separate or additional wireline or a logging tool which may take 12-18 hours of offshore rig time and may include additional cost thus making it a cumbersome, expensive and time-consuming activity.

Various top of cement (TOC) detection methods are known in the industry. Some examples are illustrated as follows. U.S. Pat. No. 10,738,590 discloses the use of a wireline tool for sensing the top of cement (TOC) during a cementing operation, wherein the wireline tool includes external sensors. As the TOC rises, the wireline tool is pulled upward in response to the sensor signals to keep the TOC midway between the sensors. Thus, U.S. Pat. No. 10,738,590 requires separate wireline to detect the top of cement which makes the process cumbersome, time consuming and expensive. U.S. Pat. No. 10,053,979 discloses circulating a doped wellbore fluid comprising a non-radioactive doped particulate material in a wellbore; and logging the wellbore with a logging-while-drilling tool to determine at least one characteristic of the doped wellbore fluid.

U.S. Pat. No. 10,539,003 discloses yet another method to determine a boundary of a cement mixture based on acoustic signals transmitted from the acoustic tags that are mixed with the cement slurry. US'003 also includes sensor boxes deployed along a side of the casing to store data indicative of the acoustic signals transmitted from the acoustic tags. U.S. Pat. No. 9,879,519 discloses two communication assemblies placed in longitudinally spaced relation to one another along the casing, wherein each communication assembly is configured to obtain excitation responses from electrodes of a fluid sensing component, where the excitation responses vary based on properties of fluids in one or more regions of the annulus surrounding the casing. Specifically, RFID tags are mixed into the fluid and the fluid is pumped into the annulus and detecting a top of cement condition responsive to detecting RFID tags.

In all the above prior art methods and other methods known in the art, at most, only the presence of the cement slurry in the annulus is able to be detected. For optimal cementation, the top of cement position must be precisely detected, so that the precise amount of additional cement required can be determined. But in the prior art, additives, tracers, or tags, etc., are mixed with the cement slurry that is pumped into the production casing so that sensors may be able to sense the tracer material in the cement slurry. As the tracer material has to be mixed with the cement slurry, large amounts of tracer material have to be used. Such methods of mixing the tracer material with the cement slurry and depositing the cement mixture containing cement and the tracer material into the casing are expensive, lengthy and unsafe to the personnel and the environment.

There is a need to develop a system that does not involve running additional or separate wireline tools to detect the upper level of cement in the annulus. Avoiding those methods of mixing tracers or detectable additives with the cement slurry is desirable, since it involves the usage of large amounts of detector or tracer material which is costly. Also, this large amount of detector or tracer material is potentially dangerous to personnel mixing the tracer into cement. The present invention uses a very small amount of detector or tracer material as the detector or tracer is only present in the leading portion of the cement slurry instead of the entire amount of cement slurry. Thus, a very small quantity of detector or tracer material is used, and there is additional safety in the method where the tracer material is contained within the wiper plug. The present invention further mitigates the need of running a separate wireline tool to identify the top of cement (TOC) and instead presents a provision within the plug itself to detect a level of cement in the annulus, thus increasing safety to the drilling environment, removing the environmental impact of running a wireline, reducing the long hours of rig time, thus reducing expenses and achieving a high degree of accuracy with respect to gathering precise data for continuous and real time detection of TOC while the cement plug advances within the wellbore.

SUMMARY

The present disclosure relates to a first, bottom or lead cement wiper plug having a frangible compartment for carrying detectable material such that when the plug lands, the impact leads to breakage of the frangible compartment such that the detectable material is released into the lead portion of the cement slurry. The present disclosure further relates to detection of the level of cement in the annular region by using detectors to detect the detectable material that is released on the lead portion of the cement slurry. The present disclosure also relates to detection of the top of cement without having to run a separate wireline or logging tool and real time detection is also achieved by the present invention.

According to an aspect of the invention, a system, method and apparatus for identification of level of cement in the annular region is disclosed. In an embodiment, a frangible compartment containing a detectable material is deployed into a first, bottom or lead cement plug or wiper plug or the casing shoe.

According to a further aspect of the present disclosure the frangible compartment is such that when the plug is launched into the wellbore ahead of a cement slurry, the mechanical impact caused due to the landing of the plug is sufficient to cause the breakage and disintegration of the frangible compartment to release the detectable material on to the lead portion of the cement slurry.

In any of the aspects or embodiments described above and herein, the level of cement in the annular region is detected by using detectors to detect the detectable material that is present on the lead portion of the cement slurry.

In any of the aspects or embodiments described above and herein, the top of cement is detected without having to run a separate wireline or logging tool.

DETAILED DESCRIPTION

Figure 1:
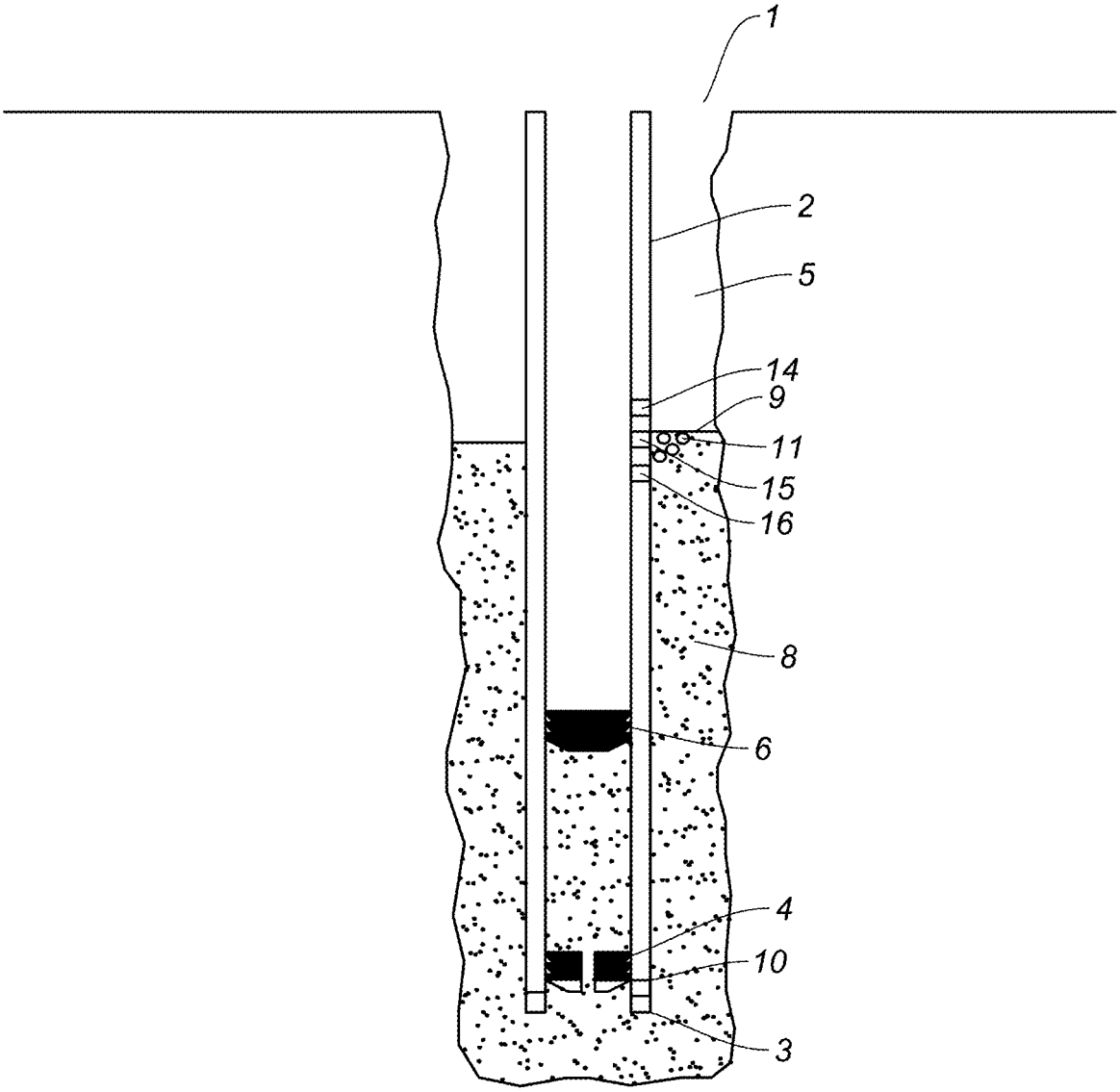
FIG. 1 illustrates the process of releasing detectable material onto the lead portion of the cement slurry.

Reference will now be made in detail to embodiments of the present teachings, examples of which are illustrated in the accompanying drawing. In the drawings, like reference numerals have been used throughout to designate identical elements, where convenient. The following description is merely a representative example of such teachings.

Present embodiments provide a system and method for detection of the top of cement (TOC) within an annulus of a wellbore during cementing operations. According to aspects of the present disclosure, FIG. 1 diagrammatically illustrates a simplified cementing operation, where a drilled borehole is represented as the wellbore 1 with a casing 2. Located at the bottom of the casing 2 is a casing shoe 3. Continuing with FIG. 1, the wellbore 1 extends down and the open area between the walls of the wellbore and the casing 2 is annulus 5. During cementing operations, a first wiper plug 4 is launched or dropped to strike the casing shoe 3 to initiate the flow of the cement slurry 8 into the annulus 5. This wiper plug 4 is designed to incorporate a frangible compartment 10. The frangible compartment 10 of the wiper plug 4 contains a detectable material 11. When the wiper plug 4 is launched into the wellbore 1 to strike the casing shoe 3, the frangible compartment 10 gets ruptured due to the impact generated by the contact and the detectable material 11 is released on to the cement slurry 8.

The cement slurry 8 continues to flow down the wellbore and down the casing shoe 3 to the annular area and travels up the annulus as shown in FIG. 1, with the detectable material present on the TOC 9. The cement slurry continues to flow until the annulus 5 is at least partially filled with cement slurry 8. A detector could be a plurality of sensors, and the sensors or detectors 14, 15 and 16 are introduced into the wellbore for detecting the detectable material 11, and are present within the casing 2 to give a positive indication of the top of cement 9. This detector could be a simple tracer detector or sensors that are merely mounted in the casing 2, or permanently fixed in the casing. Alternatively, these sensors or detectors could be mounted on the wellbore wall or deployed on outer surface of a tubular positioned within the wellbore, or on the inner surface of the casing of the wellbore, or in the vicinity of the TOC 9. The one or more detectors or sensors can be sensitive to temperature, light, vibration, sound, proximity and contact. The sensors can be controlled by the controller 20 and can be arranged at one or more locations along the wellbore, including along the tool string inside the wellbore or proximate to the casing in the wellbore. The one or more sensors can be operable to measure pressure, temperature, sound, light, contact, proximity, or any combination of these. The sensors could be made up of any material known in the art, such as metallic, piezoelectric, semiconductor, synthetic or semi-synthetic polymers and glass. Once sufficient amount of cement slurry has flown into the annulus, a second wiper plug 6 is dropped down to close the opening and hence stop further flow of the cement slurry 8 into the annulus 5. Alternatively, as the detectable material 11 moves adjacent to the detectors 14, 15 and 16, the sensor produces a signal detectable at the surface or within the wellbore, providing an indication that the cement column is adjacent the predetermined location. The signal could be one or more of acoustic, vibratory, or visible signals. In an embodiment, when the wiper plug 4 is launched into the wellbore, the wiper plug is connected to a supply of fibre optic cable such that as the wiper plug is introduced into the wellbore the fibre optic cable is extended. The fibre optic cable detects signals indicative of the top of cement.

Figure 2:
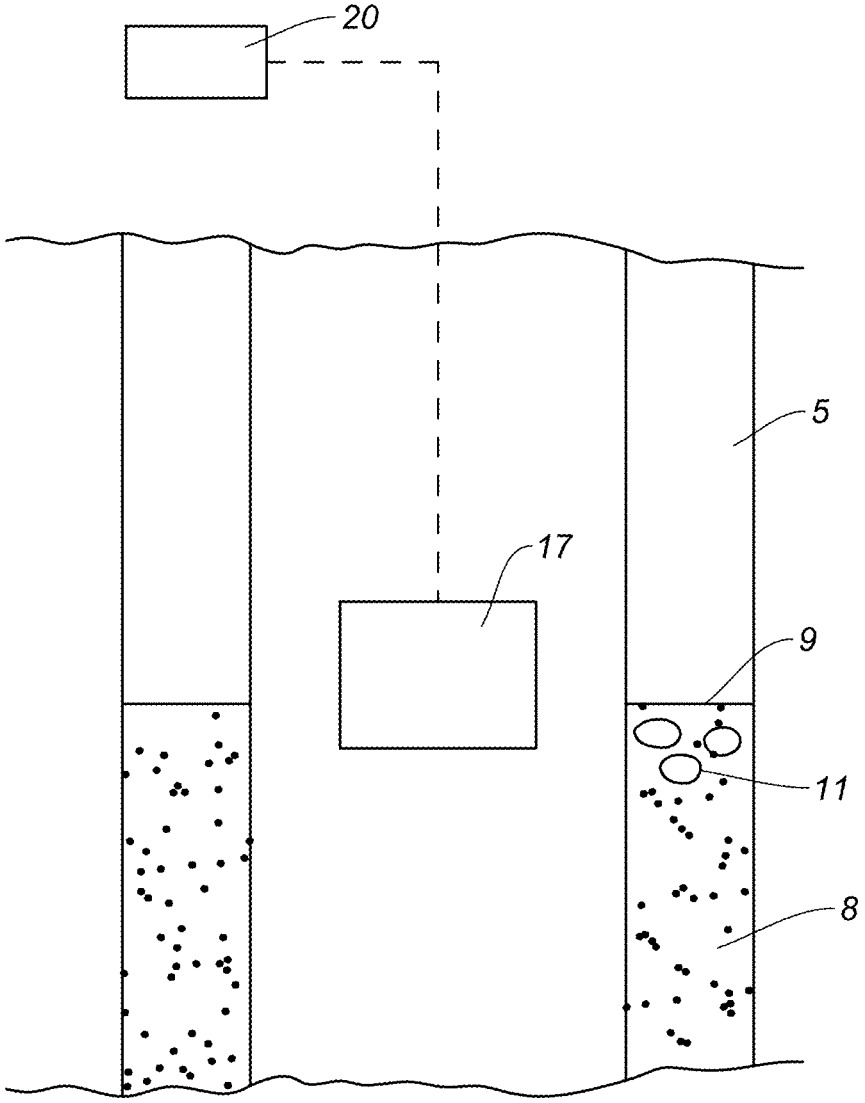
FIG. 2 illustrates an embodiment where the detector is lowered into the casing.

FIG. 2 illustrates another embodiment wherein the detector 17 is run into the casing such that the detector 17 within the casing 2 is able to identify the top of cement (TOC) 9 in the annulus 5 by detecting the detectable material present on the TOC 9.

During these series of events, the flow of the cement slurry 8 into the annulus 5 continues as the top of cement (TOC) rises up the annulus 5. To ensure that the optimal quantity of cement slurry 8 is pumped into the annulus 5, detectors 14, 15 or 16 that are strategically deployed in the casing are able to sense the TOC 9 in the annulus 5. When the TOC 9 reaches the required level in the annulus 5, this is an indication that sufficient amount of cement slurry 8 has entered the annulus 5, so the pumping of the cement is stopped and then the cement is given time to set and harden. The detectors could be a simple tracer detector or sensors that are merely mounted in the casing 2, and can be used in detecting the detectable material 11 in the TOC 9 so as to gauge the level of the TOC 9 in the annulus 5.

Figure 3:
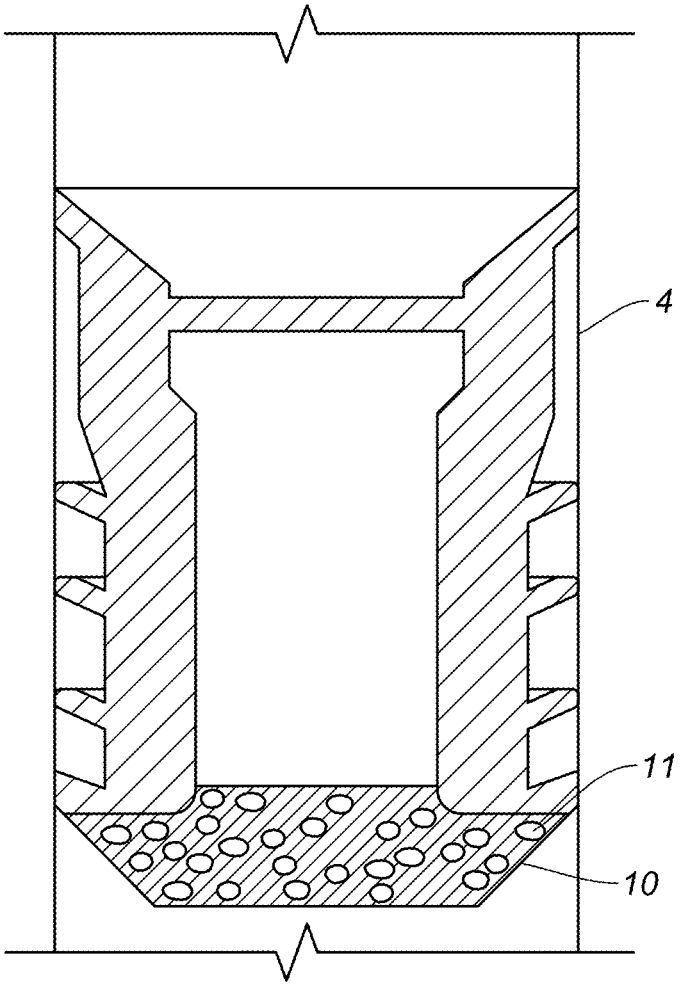
FIG. 3 illustrates a fragmentary cross-sectional view in vertical section of the wiper plug, accommodating a frangible compartment means.

FIG. 3 is a cross-sectional view showing an illustrative wiper plug 4 accommodating a frangible compartment 10 that houses the detectable material 11. The frangible compartment 10 is made out of a material that is disintegrable upon the impact that created by the landing of the wiper plug 4 within the casing shoe 3, such as composite, ceramic, metal, plastic, or combinations of the same. With the disintegration of the frangible compartment 10, the detectable material 11 is released on to the lead portion of the cement slurry 8. The detectable material 11 can be a tracer fluid that can be effectively detected by a detector. The detectable material can be radioactive or infused with sufficient non-radioactive metal (such as iron shavings) to allow for a definitive indication when detected. The detectable material can also be an additive, or an RFID tag, or fibre optic cable and real time detection of TOC can be achieved while the cement plug advances within the wellbore.

Figure 4:
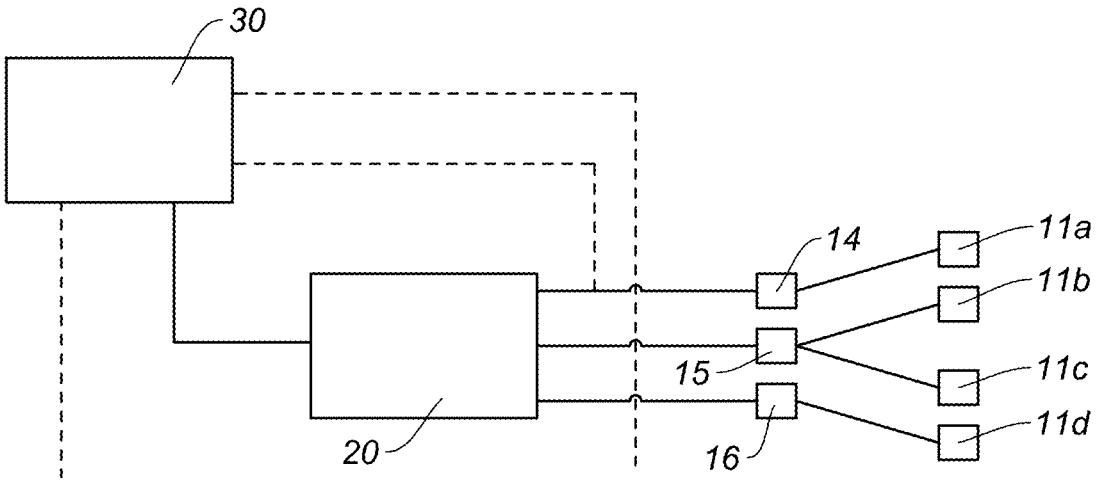
FIG. 4 is a block diagram of a system according to the present invention.

In certain embodiments, as shown in block diagram FIG. 4, a plurality of detectors 14, 15 and 16 are distributed along the length and circumference of the borehole casing, for instance, they can be mounted on the external surface of the casing. Such a placement of the detectors 14, 15 and 16 is illustrated in FIG. 1, where the detectors 14, 15 and 16 are deployed on the outer surface of the casing 2 in a certain embodiment of the present invention. The detectors 14, 15 and 16 may be welded to the casing 2 or attached by bands or through special annular fittings that affix them to the outside of the casing 2 in such a way that they do not interrupt the flow of the cement slurry 8 around the casing 2. Alternatively, the detector can also be run into the wellbore such that it can come into the vicinity of the detectable material 11 and detect the same. Once the detectable material passes by the detectors 14, 15 and 16 as shown in FIG. 1, and after the detectors 14, 15 and 16 are able to detect the detectable material 11 on the TOC 9, they may communicate with the surface equipment 30 to send the data for processing and evaluation, as required. Alternatively, a controller 20 can be coupled to the surface equipment 30. FIG. 4 illustrates an example of the communication path between the detector material 11 (11*a*, 11*b*, and 11*c*), detectors 14, 15 and 16, controller 20 and surface equipment 30. In an embodiment, the surface equipment 30 may transmit commands or other data to the detectors directly or through the controller 20. The detectors 14, 15 and 16 may communicate with the surface equipment 30 via electrical or optical cable connection, or wirelessly via radio frequency, pulse telemetry, wireless acoustic or electromagnetic transmission, and such. Based on the data, once it is confirmed that the TOC 9 has reached the required level in the annulus 5, pumping of the cement slurry 8 is stopped and then the cement is given time to set and harden.

As stated above, the controller 20 is in communication with the sensors and may be in communication with the surface equipment 30. The controller 20 may be in communication with system components to control the operation of the respective component and/or to receive signals from and/or transmit signals to that component to perform the functions described herein. The system controller may include any type of computing device, computational circuit, processor(s), CPU, computer, or the like capable of executing a series of instructions that are stored in memory. The instructions may include an operating system, and/or executable software modules such as program files, system data, buffers, drivers, utilities, and the like. The executable instructions may apply to any functionality described herein to enable the system to accomplish the same algorithmically and/or coordination of system components. The controller 20 includes or is in communication with one or more memory devices. The present disclosure is not limited to any particular type of memory device, and the memory device may store instructions and/or data in a non-transitory manner. Examples of memory devices that may be used include read-only memory, random access memory, volatile memory, non-volatile memory, static memory, dynamic memory, flash memory, cache memory, and/or any device that stores digital information. The controller 20 may include, or may be in communication with, an input device that enables a user to enter data and/or instructions, and may include, or be in communication with, an output device configured, for example to display information (e.g., a visual display or a printer), or to transfer data, etc.

The foregoing describes preferred embodiments of the invention and is given by way of example only. The invention is not limited to any of the specific features described herein, but includes all variations thereof within the scope of the appended claims.

What is claimed is:

1. A method of detecting a top of cement (TOC) within an annulus of a subterranean wellbore, the method comprising:

providing a frangible compartment in a wiper plug, the frangible compartment containing a detectable material;

launching the wiper plug into the wellbore ahead of a cement slurry;

causing the wiper plug to strike or land on a casing shoe within a casing thereby creating that causes the frangible compartment within the wiper plug to be ruptured to release the detectable material into the casing;

pumping the cement slurry to pass through the wiper plug such that the released detectable material forms a leading portion of the cement slurry and rises up in an annulus of the wellbore; and detecting the detectable material at a top of cement (TOC) when the detectable material in the annulus passes by a plurality of sensors.

2. The method of claim 1, wherein the detectable material is released from the wiper plug ahead of the cement slurry as the cement slurry advances in an annular area to seal the annulus of the wellbore.

3. The method of claim 1, wherein the detectable material is at least one of a tracer, an additive, or a detectable tag.

4. The method of claim 1, wherein the plurality of sensors are deployed on an outer surface of a tubular positioned within the wellbore, or on an inner surface of the casing of the wellbore, or on a wall of the wellbore.

5. The method of claim 1, wherein the plurality of sensors are run into the wellbore.

6. The method of claim 1, wherein the wiper plug is connected to a supply of fibre optic cable, and as the wiper plug is launched into the wellbore, the fibre optic cable is extended.

7. The method of claim 6, wherein at least one of the plurality of sensors, or the supply of fibre optic cable, or some combination thereof, is used to detect signals indicative of the TOC.

8. The method of claim 1, wherein as the detectable material moves adjacent to one or more of the plurality of sensors, the one or more of the plurality of sensors produce a signal detectable at a surface or within the wellbore, providing an indication that a cement column is adjacent to a predetermined location.

9. The method of claim 8, wherein the plurality of sensors are sensitive to at least one of temperature, light, vibration, sound, proximity or contact, and the signal produced by the plurality of sensors is at least one of acoustic, vibratory, visible, or electromagnetic.

10. The method of claim 1, wherein the detection of the top of cement (TOC) in the annulus is in real time while the wiper plug advances within the wellbore.

11. An apparatus for detecting a top of cement (TOC) within an annulus of a subterranean wellbore, the apparatus comprising:

a wiper plug having a frangible compartment within the wiper plug, the frangible compartment holding a detectable material associated with the wiper plug, and the frangible compartment configured to rupture and release the detectable material upon the wiper plug striking a casing shoe as the wiper plug is dropped into a casing ahead of introducing a cement slurry; and a plurality of sensors deployed in the wellbore to detect the detectable material when the detectable material in the annulus passes the plurality of sensors.

12. The apparatus of claim 11, wherein the frangible compartment is further configured to release the detectable material from the wiper plug ahead of the cement slurry as the cement slurry advances in the annulus.

13. The apparatus of claim 11, wherein the detectable material is at least one of a tracer, an additive, or a detectable tag.

14. The apparatus of claim 11, wherein the plurality of sensors are deployed on an outer surface of a tubular positioned within the wellbore, or on an inner surface of the casing of the wellbore, or on a wellbore wall.

15. The apparatus of claim 11, wherein the plurality of sensors are configured to detect the detectable material within the annulus.

16. The apparatus of claim 11, wherein the wiper plug is connected to a supply of fibre optic cable, and the supply of fibre optic cable is configured such that as the wiper plug is launched into the wellbore, the fibre optic cable is extended.

17. The apparatus of claim 16, wherein the plurality of sensors, and the fibre optic cable are configured to detect signals indicative of the TOC.

18. The apparatus of claim 11, wherein one or more of the plurality of sensors are configured to produce a signal detectable at a surface or within the wellbore as the detectable material moves adjacent to the one or more of the plurality of sensors, the signal providing an indication that a cement column is adjacent a predetermined location.

19. The apparatus of claim 18, wherein the plurality of sensors are sensitive to at least one of temperature, light, vibration, sound, proximity, or contact, and the signal produced by the plurality of sensors is at least one of acoustic, vibratory, visible, or electromagnetic.

20. The apparatus of claim 11, wherein the apparatus is configured to detect the top of cement (TOC) in the annulus in real time while the wiper plug advances within the wellbore.

* * * * *